United States Patent [19]

Cleevely et al.

[11] Patent Number: 4,724,978

[45] Date of Patent: Feb. 16, 1988

[54] PLASTIC CONTAINER WITH INTEGRAL TAMPER-EVIDENT, RECLOSABLE LID

[75] Inventors: Bruce T. Cleevely; Harry M. George, both of Pittsburgh, Pa.

[73] Assignee: Acorn Technology Inc., Pittsburgh, Pa.

[21] Appl. No.: 46,213

[22] Filed: May 5, 1987

[51] Int. Cl.[4] ..... B65D 51/22

[52] U.S. Cl. ..... 220/258; 220/270; 220/339; 215/237

[58] Field of Search ..... 220/258, 270, 254, 339, 220/266; 215/235, 237; 222/153, 556, 541

[56] References Cited

U.S. PATENT DOCUMENTS

| | | | |
|---|---|---|---|
| 3,282,477 | 11/1966 | Henchert | 220/258 |
| 3,434,620 | 3/1969 | Laurizio | 220/258 |
| 4,059,201 | 11/1977 | Foster | 220/258 |
| 4,361,250 | 11/1982 | Foster | 220/339 |
| 4,463,869 | 8/1984 | Lewis | 220/339 |
| 4,533,058 | 8/1985 | Uhlig | 215/237 |
| 4,533,062 | 8/1985 | Krautkramer | 220/258 |
| 4,621,744 | 11/1986 | Foster | 220/270 |

*Primary Examiner*—George T. Hall

*Attorney, Agent, or Firm*—Parmelee, Miller, Welsh & Kratz

[57] ABSTRACT

A unitary plastic container and integrally molded, tamper-evident, reclosable lid, which lid has a recessed planar member, with a rupturable portion, and an integral closure member hingedly secured thereto. The planar member and closure member provide an initial double seal for the contents of the container while the closure member provides a single seal for the contents after removal of the planar member. The container and integral lid are preferably formed from a rigid plastic material such as polypropylene.

12 Claims, 10 Drawing Figures

PLASTIC CONTAINER WITH INTEGRAL TAMPER-EVIDENT, RECLOSABLE LID

CROSS-REFERENCE TO RELATED APPLICATIONS

The present application is related to the following three co-pending applications of the present inventors filed on even date herewith: "Tamper-Evident, Reclosable, Plastic Lid"; "Reclosable, Tamper-Evident Plastic Lid for a Container Having a Circular Wall"; and "Method of Molding Rigid Plastic Members Having a Tear Element".

The present invention is to a unitary plastic container that has an integrally molded, tamper-evident, reclosable lid.

In the packaging of products, such as foodstuffs, it is important to use a container that will provide a seal for the contents of the container during shipment and storage prior to sale to the consumer. It is also desired to provide the container lid with a tamper-evident feature to warn a consumer of possible tampering with the container or its contents at the time of purchase. Additionally, it is important that the consumer, after opening the container and using only a portion thereof, is able to reseal the container to protect the contents thereof until subsequent use.

One packaging system that is prevalent is the use of a container that is formed of metal which has a tear open metal lid, to provide shelf life and a tamper-evident feature, and a supplemental plastic cover for resealing the container after the tear-away metal lid has been removed and discarded. Such dual closure systems are expensive and are subject to problems associated with the sharp metal edges of the tear-away metal lid or the rim of the metal container upon removal of the lid.

While the use of a plastic container and lid therefor has been proposed, the same are usually formed from polyethylene or other non-rigid plastic material because of the ease of molding such materials. The same, however, do not provide the desired resistance to moisture passage and oxygen impermeability that are required in packaging of certain foodstuffs. Also, resealing of such containers is a problem.

It is an object of the present invention to provide a plastic container having an integral tamper-evident, reclosable lid.

It is another object of the present invention to provide a plastic container having an integral tamper-evident, reclosable plastic lid, which is formed from a rigid plastic material.

SUMMARY OF THE INVENTION

A unitary plastic container has an integrally molded, tamper-evident, reclosable lid. The integral lid has a recessed planar member with a rupturable portion and an integral closure member hingedly secured thereto to provide for sealing of the container after the rupturable portion has been removed.

The container may be rectangularly or cylindrically shaped and has a bottom wall and upstanding side walls with an upper edge. A top wall extends inwardly from the upper edge of the side wall and has a linear inner portion with a downwardly extending face therealong. A recess is formed in the top wall that is bounded in part by the downwardly extending face, with a planar member extending across the recess, which planar member has a rupturable portion thereof which allows access by a user to the contents of the container after removal of the rupturable portion. An integral closure member is provided that is hingedly secured to the top wall adjacent the downwardly extending face and covers the recess and planar member so as to provide a double seal when the planar member is intact and a single seal for the contents of the container after removal of the rupturable portion of the planar member. Locking means are provided to secure the closure member to the top wall and seal the container.

The container and integral lid is preferably formed from a plastic material that has a tensile modulus and flexural modulus in excess of $100\times10^3$ p.s.i. (pounds per square inch) and preferably a melting point or glass transition temperature in excess of about 140° C.

DETAILED DESCRIPTION

Figure 1:
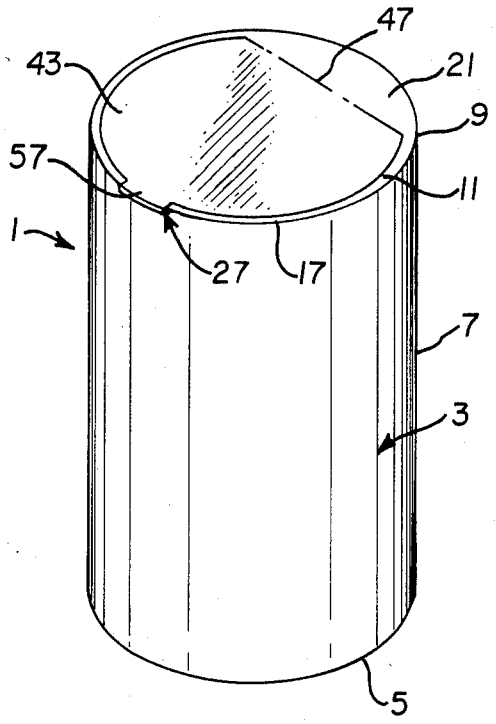
FIG. 1 is a perspective view of a unitary cylindrical container having an integrally molded, tamper-evident, reclosable lid according to the present invention showing the closure member thereof in closed position.
Figure 2:
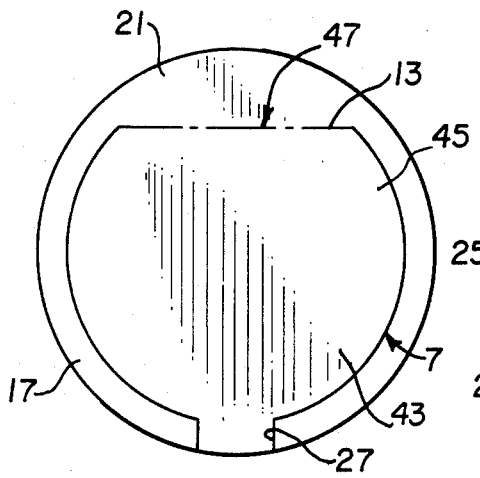
FIG. 2 is a top plan view of the container illustrated in FIG. 1.
Figure 3:
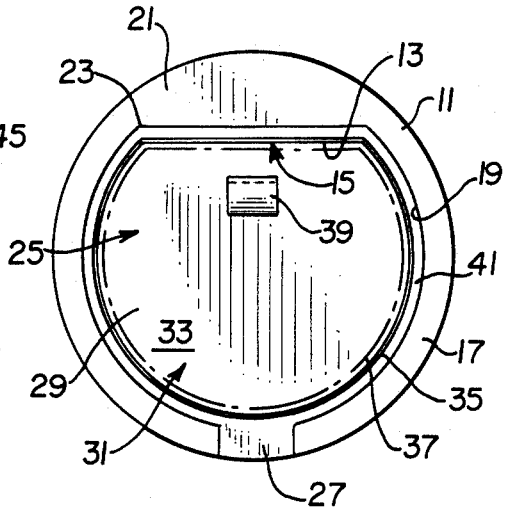
FIG. 3 is a view similar to FIG. 2, with the closure member removed to expose the planar member thereof.

A plastic container 1 having an integrally molded, tamper-evident, reclosable, plastic lid is illustrated in FIGS. 1 to 7 which is in the form of a cylindrical container 3. The cylindrical container 3 has a circular bottom 5 with an upstanding side wall 7 of cylindrical shape, the wall 7 having an upper edge 9 forming a circle. A top wall 11 extends inwardly from the outer edge 9 of the container, the top wall 11 having a substantially linear inner portion 13 with a downwardly extending face 15 therealong, and an arcuate section 17 having a downwardly extending inner wall 19. A segmental section 21 is shaped as a segment of the circle formed by the upper edge 9, with the downwardly extending face 15 extending along the chord of the segmental section 21. The arcuate section 17 merges with the segmental section 21, as at 23, to form a recess 25 bounded by the downwardly extending inner wall 19 of the arcuate section 17 and the downwardly extending face 15 of the segmental section 21. A groove 27 may be provided in the arcuate section 17 for purposes hereinafter described.

A plastic planar member 29 extends across the recess 25, the plastic planar member having a rupturable portion 31. As illustrated, the planar member 29 preferably comprises a central section 33 bonded by a peripheral section 35, with the central and peripheral sections integrally connected through a tear line 37. The tear line is formed as a weld line between two supplies of plastic material used to form the central section and peripheral section. A pull tab 39 is integrally molded with the rupturable portion 31 to enable a user to grasp the pull tab 39 and tear the central section 33 away from the peripheral section 35 along the tear line 37.

Figure 4:
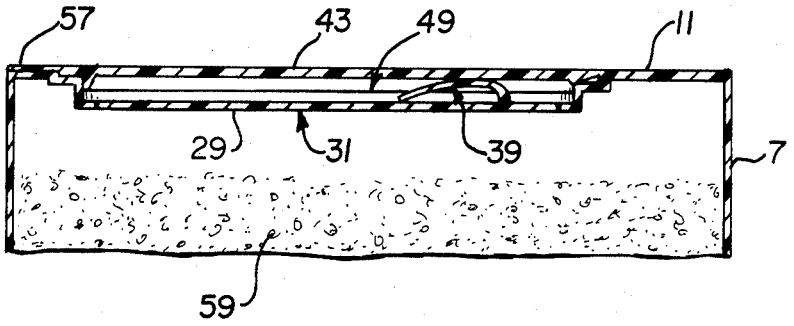
FIG. 4 is a cross-sectional view through the upper portion of the container of FIG. 1 with the planar member intact and the closure member in closed position to provide a double seal for the contents of the container.
Figure 5:
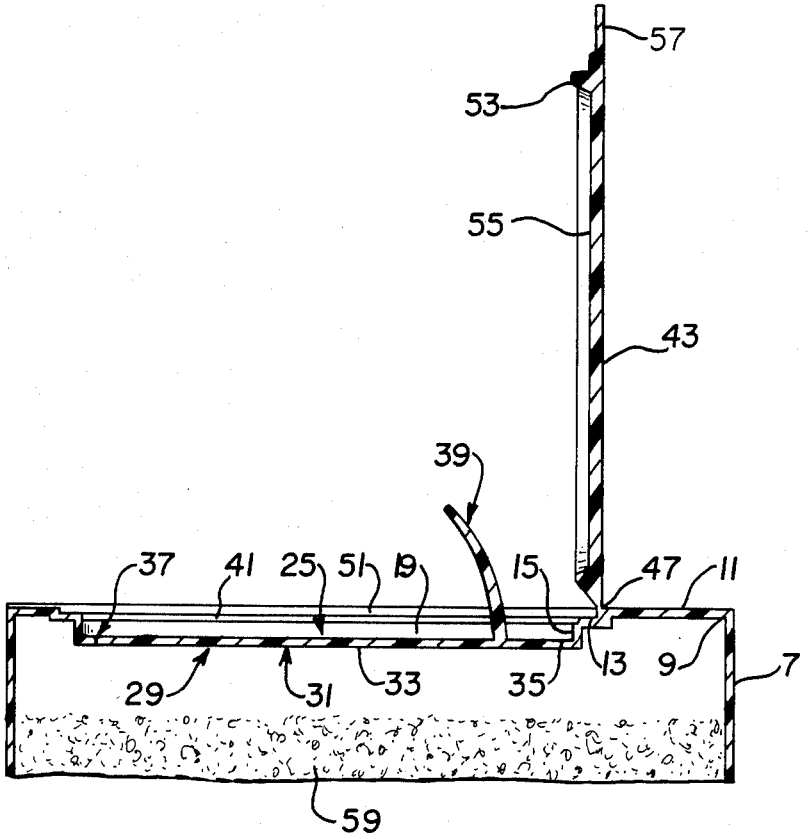
FIG. 5 is a view similar to FIG. 4 showing the closure member in open position.

A ledge 41 is preferably provided extending inwardly from the inner wall 19 of the arcuate section 17 and from the downwardly extending face 15 to receive an integral closure member 43. The integral closure member 43 comprises a cover adapted to overlie the recess 25 and planar member 31, with the periphery 45 thereof resting on ledge 41, while one end of the closure member 43 is hingedly secured by hinge 47 to the top wall 11 adjacent the downwardly extending face 15. As illustrated in FIG. 4, the closure member 43 in combination with the planar member 31 provide a double seal at the top of the container 1, with a gap 49 therebetween. Locking means, such as grooves 51 in the inner wall 19 (FIG. 5) and coacting downwardly and outwardly extending ribs 53 on the bottom surface 55 of the closure member 43, are provided to lock the closure member in an overlying relationship to the planar member 29. The closure member 43 is preferably provided with a tongue 57 that will fit into the groove 27 in arcuate section 17, to provide for grasping by the user to lift the closure member 43 from locked to open position, as shown in FIG. 5.

Figure 6:
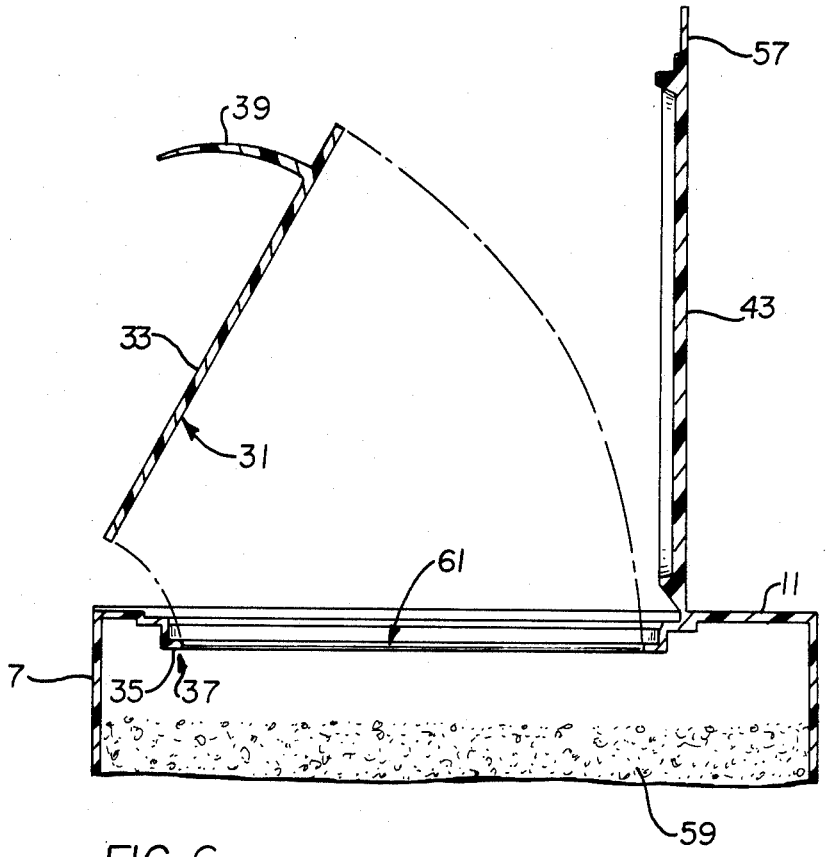
FIG. 6 is a view similar to FIG. 5 showing removal of the rupturable portion of the planar member to provide access by the the user to the contents of the container.
Figure 7:
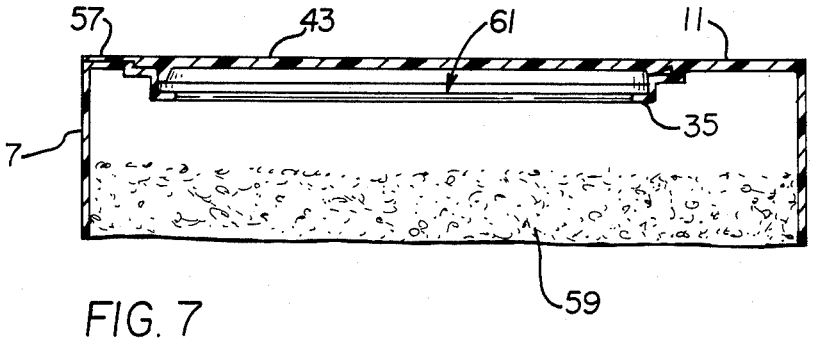
FIG. 7 is a cross-sectional view similar to FIG. 4 with the rupturable portion of the planar member removed and the closure member in closed position to provide a seal for the contents of the container.

The cylindrical container 1, is molded with the side wall 7 and top wall 11 integrally formed, the top wall 11 having the planar member 29 and closure member 43 integrally molded therewith. The open bottom container is then filled with the desired contents and the bottom 5 secured to the cylindrical wall such as by folding over a section thereof, heat sealing, or other conventional means. The contents of the container are thus sealed from the environment by the bottom wall 5, side wall 7 and top wall 11 which has a double seal comprising the planar member 29 and overlying closure member 43. When the user desires access to the contents 59 of the container 1, the user lifts the closure member 43 from locked position, grasps the pull tab 39 and removes the rupturable portion 31 of the plastic planar member 29, the central section 33, by tearing the same free from the peripheral section 35 along the tear line 37, as illustrated in FIG. 6. This enables the user to have access to contents 59 of the container through opening 61 formed by removal of the rupturable portion 31 of planar member 29. The rupturable portion 31 of the planar member 29 preferably is sized so that after removal of the same from the lid, an opening for access to the contents of the container is at least 80 percent of the area of the circle formed by the upper edge of the container side wall. After removal of the rupturable portion 31, the container can be resealed by locking the closure member 43 in position over the opening 61 as shown in FIG. 7.

Figure 8:
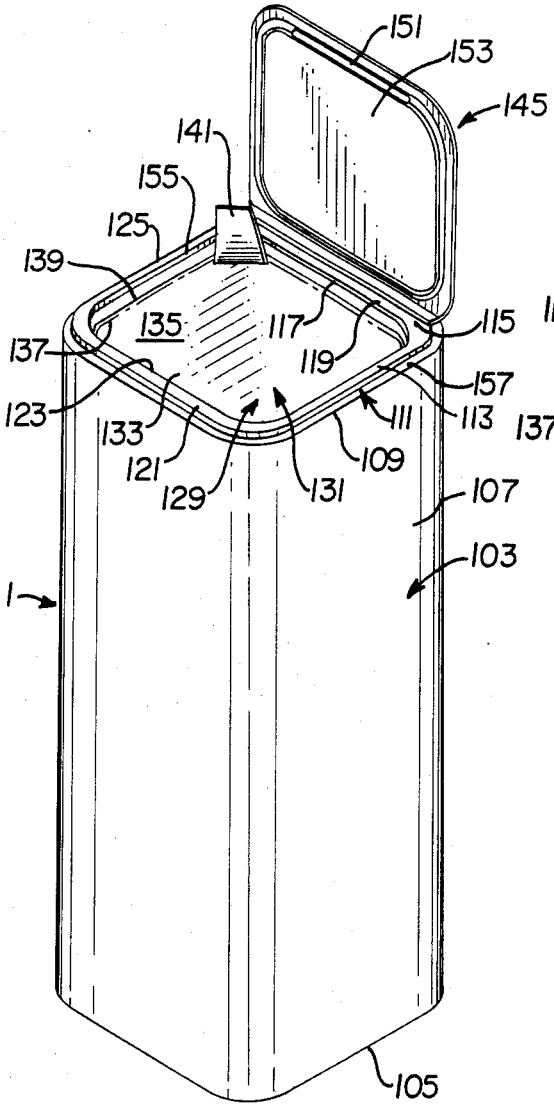
FIG. 8 is a perspective view of another embodiment of the present invention, a unitary rectangular container having an integrally molded, tamper-evident, reclosable lid, showing the closure member in open position.
Figure 9:
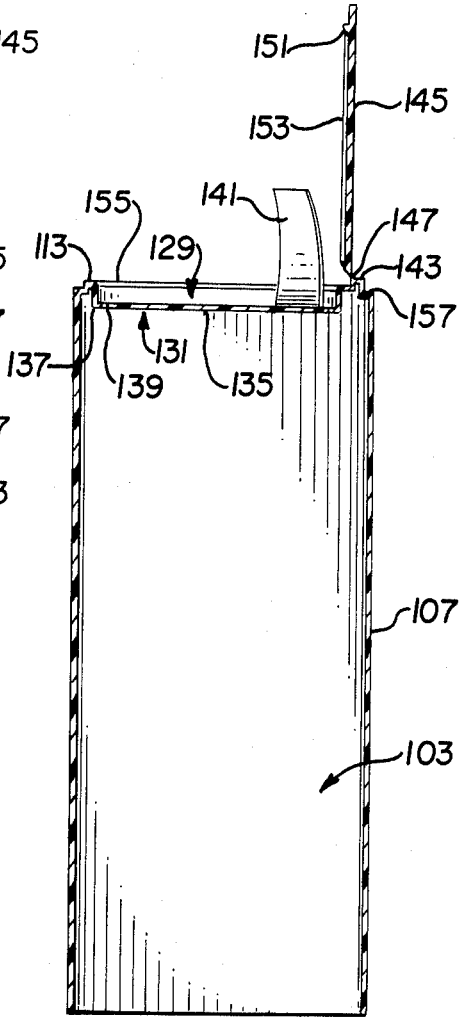
FIG. 9 is a cross-sectional view of the container of FIG. 8 prior to filling the container and sealing the bottom thereof.
Figure 10:
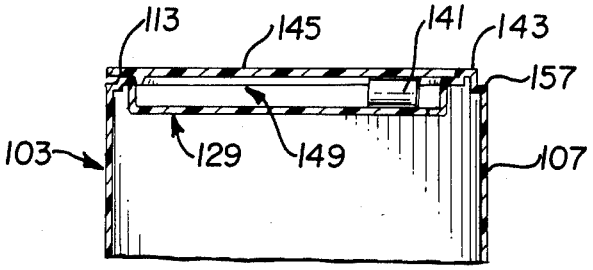
FIG. 10 is a cross-sectional view through the upper portion of the container similar to FIG. 9 showing the closure member in closed position and the planar member intact to provide a double seal for the contents of the container.

Another embodiment of the plastic container is illustrated in FIGS. 8 to 10, the container 1 having an integrally molded, tamper-evident, reclosable plastic lid, and having a rectangular or square shape. The rectangular container 103 has a bottom wall 105 and upstanding side walls 107 which terminate at upper edges 109. A top wall 111 extends inwardly from the edges 109 and has a raised platform 113 thereabout. A substantially linear portion 115 is provided on the top wall, at the inner surface 117 of a portion of the platform 113, as is a downwardly extending face 119 along the substantially linear portion 115. The platform 113 also comprises an opposed inwardly extending rim 121, opposite the downwardly extending face 119, having a confronting inner wall 123 and a pair of inwardly extending side rims 125, which interconnect the opposed rim 121 to the linear portion 115, and have downwardly extending inner walls 127. The downwardly extending face 119, inner wall 123, and inner walls 127 form a recess 129 in the top wall 111.

Extending across the recess 129 is a plastic planar member 131 having a rupturable portion 133, the rupturable portion preferably comprising a central section 135 interconnected to a peripheral section 137 through a tear line 139. A pull tab 141 is integrally molded with the rupturable portion 133 to enable the user to grasp the same and remove the central section 135 from the peripheral section 137 along the tear line 139.

The substantially linear portion 115 of the raised platform 113 has a raised shoulder 43 thereon to which there is integrally molded a closure member 145, through hinge 147. The integral closure member 145 is hingedly secured to the top wall 111 adjacent the downwardly extending face 119 and is adapted to completely cover the recess 129 and the planar member 131 therein. In closed position, with the planar member 129 intact, the closure member 145 provides a double seal in conjunction with the planar member 129 as shown in FIG. 10. An enclosed space or gap 149 is provided between the closure member 145 and the planar member 129. The closure member 145 is sized so as to form a planar surface with raised shoulder 143 when in closed position. Locking means are provided to lock the closure member to the platform 113, illustrated as a downwardly and outwardly extending flange 151 about the bottom surface 153 of the closure member 145 which coacts with ribs 155 on the inner walls 123 and 127 of the platform 113.

The platform 113 may be spaced from the upper edges 109 of the side walls 107 of the container so as to provide a support base 157 in the nature of a shoulder about the periphery of the top wall 111, to enable stacking of containers one atop another, with the bottom wall 105 recessed.

The unitary plastic container of the present invention is formed from a plastic material that provides the requisite stiffness and other properties desired. For example, the plastic should have environmental stress crack resistance to prevent damage to the container by oils or vapors from the contents thereof, as well as oxygen and moisture impermeability sufficient to provide a desired shelf life for the contents of the container. Expecially useful plastics are polypropylene and copolymers thereof having up to about 6 percent of a comonomer such as ethylene, and preferably less than about 3 percent of such a comonomer, or ethylene and a termonomer such as butene -1, pentene -1 or hexene -1, the total thereof being less than about 6 and preferably less than 3 percent may be used. Other plastics having the desired properties may be used, such as a nylon polymer such as nylon 6 or nylon 6/6, a polymethyl pentene polymer, or a polycarbonate. The tensile modulus of the plastic material is preferably in excess of about $100\times10^3$ p.s.i. according to ASTM D638, and the flexural modulus is preferably in excess of about $100\times10^3$ p.s.i. according to ASTM D790, while the melting point or glass transition temperature is preferably in excess of 140° C.

The planar members, 29 or 131, preferably have a thickness of between about 0.030 to 0.040 inch, with the tear line of a thickness of between 0.002 to 0.007 inch and a width of between 0.001 and 0.25 inch. The tear line is formed at a weld between the plastic material of the central portion of the planar member and the peripheral portion of the planar member. Especially when the container is formed solely from polypropylene, a tear line thickness of less than 0.002 inch is unusable because the flow of polypropylene into the tear line area cannot be effected, while a thickness greater than about 0.007 provides a tear line that is too difficult to tear and/or leaves undesirable jagged edges along the tear line. A correlation exists between the thickness and width of the tear line in that the larger the thickness of the tear line in the range that is used, the larger the width of the tear line, within the respective range, that is required, i.e., a tear line of about 0.007 inch thick would require a width of about 0.025 inch, while a thickness of about 0.002 inch requires a width at the lower range thereof, or about 0.001 inch. The integral hinge, 47 or 147, should have a thickness of about 0.008 to 0.012 inch, preferably 0.010 inch. The hinge cannot be less than about 0.008 in thickness since flow across the section of the mold cavity to form the hinge and subsequently the closure member is very difficult, while a hinge thickness of greater than about 0.012 inch would not provide the requisite pliability and hinge action needed.

What is claimed is:

1. A plastic container having an integrally molded tamper-evident, reclosable, plastic lid comprising:

a bottom wall and upstanding side walls having an upper edge thereon;

a top wall extending inwardly from the upper edges of said side walls, said top wall having a substantially linear inner portion and a downwardly extending face along said substantially linear inner portion;

a recess formed in said top wall bounded in part by said downwardly extending face;

a plastic planar member extending across said recess;

a rupturable portion on said planar member allowing access to the contents of the container when said rupturable portion is removed;

an integral closure member hingedly secured to said top wall adjacent said downwardly extending face, adapted to completely cover said recess and said planar member therein; and locking means for securing said closure member to said top wall when in closed position.

2. A plastic container having an integrally molded, tamper-evident, reclosable plastic lid as defined in claim 1 wherein said container is formed from a plastic material having a tensile molulus in excess of about $100\times10^3$ p.s.i., a flexural modulus in excess of about $100\times10^3$ p.s.i., and a melting point in excess of 140° C.

3. A plastic container having an integrally molded tamper-evident, reclosable, plastic lid as defined in claim 1 wherein the upper edge of the upstanding side walls form a circle, and said top wall comprises an arcuate section having a downwardly extending inner wall and a segmental section shaped as a segment of said circle, with said downwardly extending face extending along the chord of said segment, said arcuate section and segmental section merging such that the inner wall of said arcuate section and said downwardly extending face form the bounds of said recess.

4. A plastic container having an integrally molded tamper-evident, reclosable, plastic lid as defined in claim 3 wherein the rupturable portion on said planar member is sized so as to provide, when removed from said lid, an opening for access to said container which is at least 80 percent of the area of the circle formed by said upper edge of the upstanding side walls.

5. A plastic container having an integrally molded tamper-evident, reclosable, plastic lid as defined in claim 4 wherein the rupturable portion on said planar member comprises a central portion bounded by an outer peripheral portion, and a tear line is formed intermediate said central and peripheral portions.

6. A plastic container having an integrally molded tamper-evident, reclosable, plastic lid as defined in claim 5 wherein said plastic container is formed completely of polypropylene.

7. A plastic container having an integrally molded tamper-evident, reclosable, plastic lid as defined in claim 6 wherein said central and peripheral portions of said planar member have a thickness of between about 0.030 to 0.040 inch, and said tear line has a thickness of 0.002 to 0.007 inch and a width of about 0.001 to 0.025 inch.

8. A plastic container having an integrally molded tamper-evident, reclosable, plastic lid as defined in claim 1 wherein the upper edge of said upstanding side walls form a rectangle and said top wall comprises said substantially linear inner portion, an opposed inwardly extending rim and a pair of inwardly extending side rims, said opposed and pair of said rims having a downwardly extending inner wall, with said downwardly extending face and downwardly extending inner walls of said opposed and side rims forming the bounds of said recess.

9. A plastic container having an integrally molded tamper-evident, reclosable, plastic lid as defined in claim 8 wherein the rupturable portion on said planar member comprises a central portion bounded by an outer peripheral portion, and a tear line is formed intermediate said central and peripheral portions.

10. A plastic container having an integrally molded tamper-evident, reclosable, plastic lid as defined in claim 9 wherein said plastic container is formed completely of polypropylene.

11. A plastic container having an integrally molded tamper-evident, reclosable, plastic lid as defined in claim 10 wherein said central and peripheral portions of said planar member have a thickness of between about 0.030 to 0.040 inch, and said tear line has a thickness of 0.002 to 0.007 inch and a width of about 0.001 to 0.025 inch.

12. A plastic container having an integrally molded tamper-evident, reclosable, plastic lid as defined in claim 8 wherein said closure member covers all of said recess, said opposed inwardly extending rim, and said pair of inwardly extending side rims.

* * * * *